US008215318B2

(12) United States Patent
Jacob

(10) Patent No.: US 8,215,318 B2
(45) Date of Patent: Jul. 10, 2012

(54) DEVICE, SYSTEM, AND METHOD FOR APPLYING HAIR COLOR

(76) Inventor: Margaret Jacob, Ranier, OR (US)

( * ) Notice: Subject to any disclaimer, the term of this patent is extended or adjusted under 35 U.S.C. 154(b) by 1 day.

(21) Appl. No.: 12/948,403

(22) Filed: Nov. 17, 2010

(65) Prior Publication Data

US 2011/0132390 A1 Jun. 9, 2011

Related U.S. Application Data

(60) Provisional application No. 61/267,649, filed on Dec. 8, 2009.

(51) Int. Cl.
*A61K 8/18* (2006.01)
*A45D 19/18* (2006.01)

(52) U.S. Cl. ..... 132/208; 132/202; 132/270; 15/160; 15/166; 15/257.05; 434/94; 434/100

(58) Field of Classification Search ..... 132/202, 132/207, 208, 209, 108–112, 120, 221, 222, 132/270; 15/160, 166, 257.05, 257.01; 206/223, 206/581, 1.7, 1.8, 572, 361; 434/81, 94, 434/95, 98, 99, 100
See application file for complete search history.

(56) References Cited

U.S. PATENT DOCUMENTS 2,190,277 A 2/1940 Viragh
3,349,781 A * 10/1967 Rene et al. ..... 132/208
5,349,970 A * 9/1994 Razzouq ..... 132/208
5,433,225 A * 7/1995 Liggett et al. ..... 132/208
5,549,126 A * 8/1996 Green ..... 132/270
5,596,785 A 1/1997 Park
5,626,153 A * 5/1997 Petrarca ..... 132/126
5,664,590 A * 9/1997 Plateroti et al. ..... 132/270
6,497,130 B2 12/2002 Nilsson
6,666,215 B1 * 12/2003 Bulriss ..... 132/222
6,863,076 B2 * 3/2005 Russell ..... 132/222
6,994,097 B1 2/2006 Palmeri
7,191,783 B2 3/2007 Russell
7,322,365 B2 * 1/2008 Kelloyan ..... 132/200
7,628,160 B2 * 12/2009 Winup ..... 132/124
2004/0129287 A1 * 7/2004 Russell ..... 132/222
2007/0119473 A1 * 5/2007 Russell ..... 132/222
2008/0053475 A2 * 3/2008 Castagno et al. ..... 132/320

OTHER PUBLICATIONS

Author Unknown and Date Unknown, screen shot of web site http/salon.wimexbeauty.com Product No. 68075, Salon Tinting Spatula.
Author Unknown and Date Unknown, screen shot of web site http/salon.wimexbeauty.com Product No. 68053 Salon large tint brush.
Author Unknown and Date Unknown, screen shot of web site http/salon.wimexbeauty.com Product No. 68928 Salon tint bowl with partition.

* cited by examiner

*Primary Examiner* — Todd Manahan
*Assistant Examiner* — Tatiana Nobrega
(74) *Attorney, Agent, or Firm* — Peter A Haas Esquire LLC

(57) ABSTRACT

A system for coloring hair includes a specialized brush having a narrow tapered end and an elongated handle portion and an opposite bristle head consisting of at least three bristle grouping. Each bristle grouping is separated by a gap. The bristle groupings align with corresponding channels on a color tray. The color tray consists of at least three parallel and elongated channels, each channel can retain a separate color chemical.

2 Claims, 2 Drawing Sheets

DEVICE, SYSTEM, AND METHOD FOR APPLYING HAIR COLOR

PRIORITY CLAIM

The present application claims benefit under 35 USC Section 119(e) of U.S. Provisional Patent Application Ser. No. 61/267,649 filed on 8 Dec. 2009: The present application is based on and claims priority from this application, the disclosure of which is hereby expressly incorporated herein by reference.

BACKGROUND

The present invention relates to devices, systems, and methods related to applying fluid treatments to a head of hair. More specifically, the present invention relates to a brush and tray for hair coloring treatments for humans.

For many people, the cut, style, color, and texture of their hair speaks of their personality, symbolizes beauty, enhances self-confidence, emboldens them, creates a first impression, and is otherwise of vital importance. Not surprisingly, a number of devices, systems, and methods exist to enhance or alter a person's head of hair. One particularly popular method of coloring, styling, texturing, and shaping hair includes a technique called "weaving".

Weaving is the art of adding human hair or synthetic hair to the scalp by weaving or braiding the additional hair to the root area of the existing hair of. It is also called Hair integration or Hair Intensification. The hair is woven to the root area so that it grows naturally with the existing hair.

To accomplish integration of the additional hair to the existing hair, a stylist will use common tools including a rat-tail comb, a brush to apply colors and/or bonding agents, and foil or other chemical-impervious substrates to isolate a section of hair being treated. Often, additional coloring agents are applied during a weave.

Hair foil and hair holding systems for applying chemicals to hair are generally known in this art. Russell, in U.S. Pat. No. 7,191,783, issued on 20 Mar. 2007, describes a system, a method, and appliances for applying hair treatments. Therein, the common practice and tools are well documented: a paper or foil, typically a small rectangular sheet of chemical-impervious material, is laid on the underside of a part line. Selected strands of hair are arranged on the foil. Coloring chemicals are applied to the selected strands of hair using a brush, foam, or sponge. The foil is then folded on itself to cover and seal the treated strands of hair, and the foils protect the adjacent untreated hair from the treatment chemicals. This process is repeated, perhaps several dozens of times, until the desired color affect is achieved. Russell improves upon this technique by providing a hair-holding appliance with an anchoring strip. While the Russell appliances and method improve the efficiency of coloring and weaving, there remains a need for additional improvements in this art that further speed-up this labor-intensive process, and provide for more flexibility and creativity with the use of color in the hair.

Other known apparatus and methods representative of the current state-of-the-art and general level of knowledge in this art include the disclosures of: Razzouq in U.S. Pat. No. 5,349,970 issued on 27 Sep. 1994 for a method for foiling hair; Bulriss in U.S. Pat. No. 6,666,215 issued on 23 Dec. 2003 for a device and method for selectively applying hair treatment; Russell in U.S. Pat. No. 6,863,076 issued on 8 Mar. 2005 for a foil for use in hair coloring and method of use; and Palmeri in U.S. Pat. No. 6,994,097 issued on 7 Feb. 2006 for a hair treatment and styling method related applications.

And, other known apparatus, that may have bearing on the present invention, but are not thought to be representative of the state-of-the-art in hair coloring include: the dental brush of Viragh in U.S. Pat. No. 2,190,277 issued on 13 Feb. 1940; the multi-utility shoe brush system of Park in U.S. Pat. No. 5,596,785 issued on 28 Jan. 1997; and Nilsson's method for corrugating a metal foil and packages of such foil in U.S. Pat. No. 6,497,130 issued on 24 Dec. 2002.

Despite advances in apparatus and methods, there remains yet a need for a system, device and method that enables a salon stylist or at-home self-stylist to prepare and apply colors and other chemical treatments to localized strands of hair in an efficient, economical and less-work intensive manner. There remains yet a need for a system that enables more creative styles and colors of hair. And, there remains a need for a system that requires less skill and practice as is generally required in the existing-art.

SUMMARY OF THE INVENTION

The present invention overcomes limitations of the prior and known art and provides a device, system and method to quickly and efficiently color hair, while at the same time reduces the level of skill required to color hair. The system, method and device of the various preferred embodiments of the present invention enable home-stylists as will as professional stylist to quickly and easily weave and color hair and apply other chemical treatments. The present invention enables the stylist to be more creative and to have more fun.

In one preferred embodiment the present invention consists of a beauty salon kit (for at-home or for a professional salon). The kit includes two specially designed brushes, each brush corresponding to a tray. One tray includes three, longitudinally aligned, parallelly arranged trough compartments and its brush includes three separate sections of bristles with a gap between each section of bristles. The bristles arrange on the brush to align in the three compartments so that a single stroke of the brush against the tray results in the simultaneous insertion of each of the three bristle groupings in the compartment. Similarly, the second tray includes four compartments and the brush includes four separate bristle groupings. The kit further includes a corrugated tray (or paddle) adapted for use with a foil sheet whereby the foil sheet follows the contours of the tray to create three or four parallel ridges. The kit includes at least two, and preferably three containers for holding chemicals. In one embodiment the three containers include a red, yellow, and blue color so that custom mixing of these primary colors can enable the stylist to create any imaginable color. The kit further includes a pair of gloves and foil sheets. The foil sheets include both long (9-inch) versions and short versions (5 inches or so).

One preferred method includes a stylist working on a client's hair. The stylist sections off the hair, then subsections each section into three or four sections of about ¼-inch to about ½-inch width sections of hair. The stylist, using the straight end of the brush or the tail end of a rat-tail comb, weaves through the section of hair and place that hair onto a foil strip and places the foil strip on to the corrugated paddle, pushing the foil to mimic the contours of the paddle so that three or four ridges are made in the foil. The three or four subsections of hair are placed in their own ridge section on the foil. Then, the special brush is run through the color tray so that each grouping of bristles absorbs the color placed in that channel. (Of course, the color would be pre-mixed and placed in the color tray. A stylist may select one, two, three, or four different colors/shades/tints, as desired). The wet brush is then run across the subsectioned hair in the ridges on the foil.

After applying the color, the foil is wrapped over the hair as would be customarily done in the art of coloring hair.

Some of the benefits of the present invention include enabling a stylist to more conveniently; simply, and easily apply tow or more colors, or bleach, or other chemical treatments, to a head of hair. The present invention reduces the amount of time required to color treat hair compared to the current teachings in the art. The present invention better isolates different colored segments of hair during the coloring and curing phases. And, the present invention simplifies the coloring process to the point where some people can now color their hair by themselves and yet achieve salon-like results.

One preferred embodiment of the present invention is currently being developed under the trade name Weave-Eez brand hair coloring kit, now available from www.weaveeez-.com or PO Box 721, Longview, Wash. 98632, USA and is appreciating considerable commercial success.

DRAWING

DESCRIPTION OF THE INVENTION

Possible embodiments will now be described with reference to the drawings and those skilled in the art will understand that alternative configurations and combinations of components may be substituted without subtracting from the invention. Also, in some figures certain components are omitted to more clearly illustrate the invention.

Figure 1:
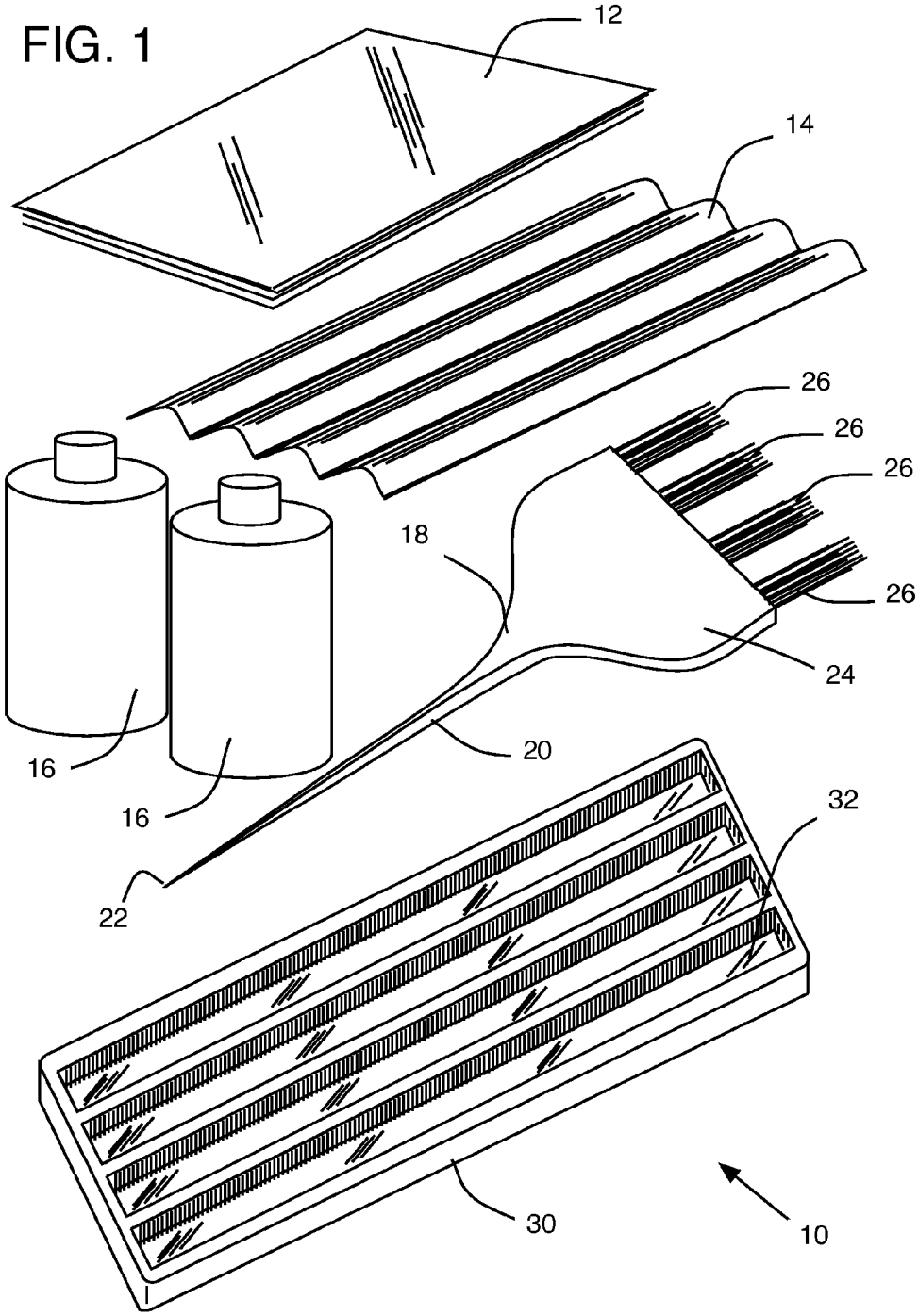
FIG. 1 illustrates the components and devices of a first system according to a first preferred embodiment of the present invention.

One preferred system 10 of the present invention, as FIG. 1 illustrates, incorporates the devices of the various preferred embodiments. This system includes a plurality of foil sheets 12. Foil sheets are well understood in this art and consist of a chemical-impervious substance, such as aluminum foil or plastic, and may be about 5-inches in length or about 11-inches in length. One well-suited foil sheet is available under the trade name Reynolds 711, available in a 500-count box (available from sallybeauty.com as item number SBS-466100), each sheet having a width of about 9-inches and a length of about 10.75-inches. These sheets may be cut in half, or used as is.

The system further includes a paddle 14 having undulating ridges to form elongated channels. The paddle resembles a corrugated sheet. In one embodiment, the paddle comprises three ridges and three troughs; in a second embodiment the paddle comprises four ridges and four troughs. The prior-art teaches a salon tinting-spatula having a handle portion connected to a larger flat portion without any undulating surface. A representative prior art spatula includes product number 68075 available from Wimex Beauty at salon.wimexbeatuy-.com, for example. The paddle of the present invention can be made of similar material, as would be well-understood by those skilled in this art. However, the paddle of the present invention improves upon the known art by eliminating the handle, which is cumbersome and hinders use for applying color, especially when more than one color is applied to the hair in one stroke of a brush, according to the method of the present invention. Moreover, the undulating ridge pattern of the paddle of the present invention creates an inherently more rigid and stiff paddle, thus allowing less material to be used in the molding of the paddle, which saves on costs and is more efficient to produce. Further, the foil sheet is placed on the paddle and pressed against the paddle so the rigged pattern of the paddle is mimicked in the foil—and this use will be explained further herein.

The system further includes at least one, and preferably two containers 16 for color, bleach, or other chemicals. The containers include a resealable lid that closes tightly so that the container with its contents may be shaken up to fully mix the chemicals or colors. The container includes a surface adapted for writing so that the contents may be identified.

The system also includes a specialized brush 18. The prior-art teaches a brush with an elongated handle portion and varying length bristles. For example, a large tint brush available from Wimex Beauty part number 68053 (salon.wimex-beatuy.com) is representative of the art. The brush of the present invention can be similarly made of similar material. In fact, this brush can be modified to work with the system of the present invention by removing intermediate bristle groupings. However, the brush of the present invention departs from the conventional teaching in that it has distinct groupings of single-length bristles and a void (with no bristles whatsoever) in between each bristle grouping. The, the present invention's brush includes a handle portion of the brush consisting of an elongated and narrow member 20 terminating in a rounded tip 22. This is similar to the handle or tail portion of a rat-tail comb. The tapering narrow point 22 and long handle member 20 enables a stylist to weave the hair, without needing a second tool. At an end opposite the handle-portion, the brush includes a bristle head 24. The bristle head includes distinct groupings of bristles. Each grouping of bristles is about ¼-inch to about ½-inch wide. Each grouping of bristles is separate by a gap or opening of about the same thickness as the grouping. For example, FIG. 1 shows this specialized brush 18 with four bristle groupings 26. The arrangement of bristle groupings corresponds to the ridges on the paddle and the color tray compartment on the color tray 30.

A typical salon tint brush includes ten or eleven bristle groupings, each bristle grouping includes a single given length of bristles. In one conventional example, all the eleven bristle groups are the same length, thus presenting a unified or single striking edge of the bristles. In other examples a salon tinting brush includes pairings of bristles, where each pair of adjacent bristles are the same length and the brush includes both long and short bristles. Thus, the first and second bristle group are long, the third and fourth are short, the fifth and sixth are long, the seventh and eighth are short, and the ninth and tenth are long. The present invention, in one preferred embodiment, eliminates the short bristle groupings—thus there are three distinct striking edges of the brush.

The system also includes a color tray 30 consisting of parallel and elongated channels or compartments 32. Each compartment is separate from the other compartments so that an individual color or chemical can be inserted and retained in the compartment and each compartment is relatively shallow relative to its length. FIG. 1, for example, shows a tray 30 with four compartments 32. This tray is intended for use with the specialized brush 18 having four bristle groups 26 and the paddle 14. The prior art teaches a tint bowl having two portions. The tint bowl is deep relative to its length and is ill-suited for use with the method and devices of the present invention. One representative prior-art tint bowl includes part number 68928 available from Wimex Beauty at salon.wimex-beatuy.com, for example. Although the shape and design of this known bowl will not work for the present invention, its material and molding method of fabrication may be mimicked in the present invention, as would be well-understood in the art.

It will be appreciated that this arrangement of devices in this system enables a stylist to simultaneously apply up to four different colors, shades of color, tints, chemicals and the like in a single swipe of the brush.

Figure 2:
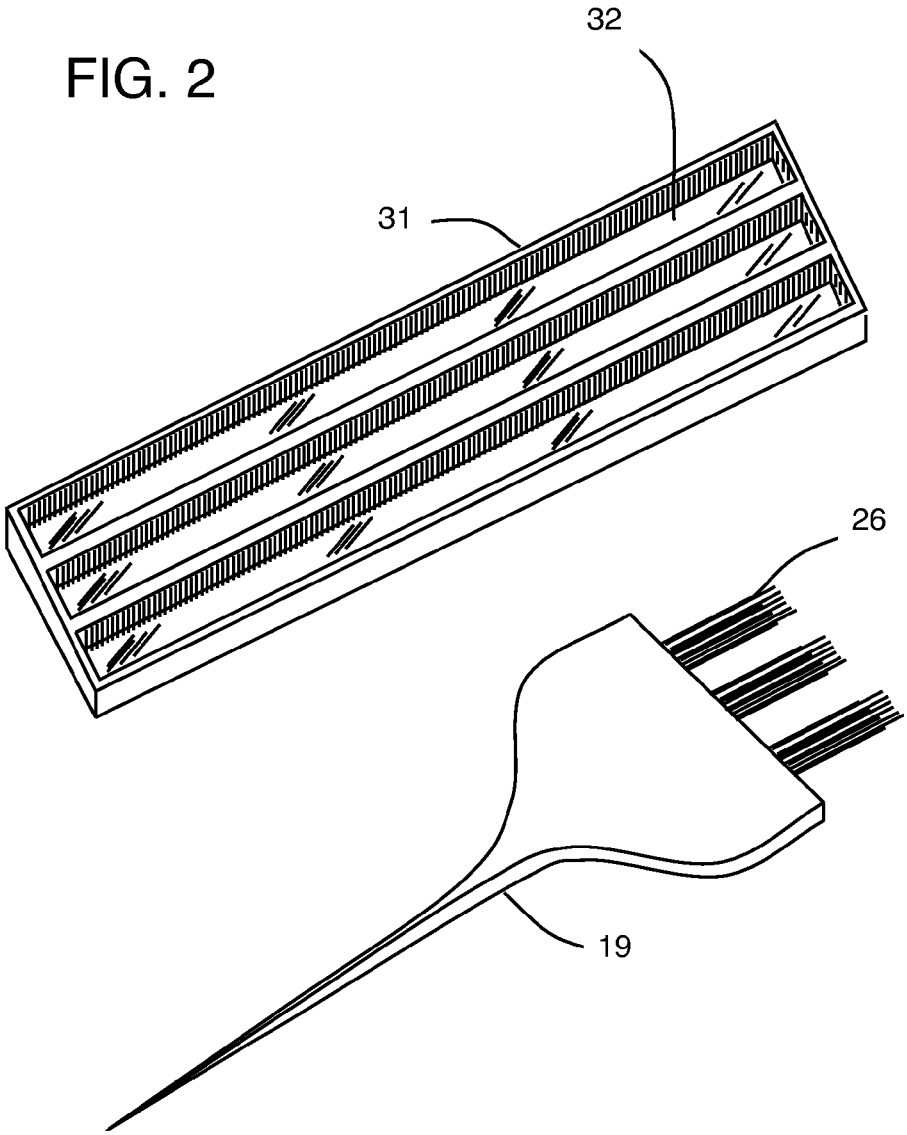
FIG. 2 illustrates the devices of a second system according to a second preferred embodiment of the present invention.

FIG. 2 shows a second preferred embodiment of a kit consisting of a specialized brush 19 having three bristle groupings 26 and a color tray 31 with three compartments 32. The containers, paddle, and foil sheets are omitted from FIG. 2; however, it will be appreciated that these components would work similarly with out modification.

A third preferred embodiment includes a kit that combines the 3-bristle group brush 19 and color tray 31 with the kit of the first preferred embodiment. This collection of devices is combined in a single package, thus enabling the stylist a full set for broad and narrow color applications as the situation warrants.

Additional components that are not depicted in the figures include gloves or pre-mixed color sets. Both of these components are well-understood and readily available products in the hair treatment arts.

One preferred method according to the present invention includes the steps consisting of: providing a kit having a color tray having three or four color compartments, at least two color containers, a paddle, a specialized brush having three or four bristle groupings to correspond with compartments on the color tray; providing foil sheets; identifying the color for each compartment, labeling the color containers accordingly, selecting the colors desired for the hair, mixing the colors, placing an individual color in each compartment of the color tray, place a foil sheet on the paddle, weaving the hair to form a part, section and subsection in the hair, dipping the brush in the color tray, holding the paddle and foil against the hair, placing each subsection of hair in its own ridge on the foil, applying color from the scalp end of the hair to the tips, and wrapping the foil normally. This process repeats until the full amount of hair being colored is completed.

To fully prepare the hair for color, a stylist may first elect to wash and dry the hair, then fully bleach the hair, wash again, dry again and then apply the preferred method, above.

Although the invention has been particularly shown and described with reference to certain embodiments, it will be understood by those skilled in the art that various changes in form and detail may be made without departing from the spirit and scope of the invention.

I claim:

1. A method comprising:

providing a kit having a color tray having three or four color compartments, at least two color containers, a paddle, a specialized brush having three or four bristle groupings to correspond with compartments on the color tray;

applying three or four colors simultaneously from the scalp end of the hair to the tips;

providing foil sheets;

selecting the colors desired for the hair;

placing an individual color in each compartment of the color tray;

placing a foil sheet on the paddle;

weaving the hair to form a part, section and subsection in the hair;

dipping the brush in the color tray;

holding the paddle and foil against the hair;

placing each subsection of hair in its own ridge on the foil; and wrapping the foil over the hair.

2. The method of claim 1 further comprising:

mixing the colors;

identifying the color for each compartment; and labeling the color containers corresponding to the mixing of colors.

* * * * *